US007721474B2

(12) United States Patent
Jiang et al.

(10) Patent No.: US 7,721,474 B2
(45) Date of Patent: May 25, 2010

(54) METHOD FOR CONTROLLING AN IRONING TEMPERATURE DURING A STEAM IRONING PROCESS AND A CORRESPONDING STEAM IRON

(75) Inventors: Yong Jiang, Singapore (SG); Boon Khian Ching, Singapore (SG); Mohankumar Valiyambath Krishnan, Singapore (SG); Peter Jeeninga, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 121 days.

(21) Appl. No.: 11/630,298

(22) PCT Filed: Jun. 15, 2005

(86) PCT No.: PCT/IB2005/051974

§ 371 (c)(1),
(2), (4) Date: Dec. 19, 2007

(87) PCT Pub. No.: WO2006/000958

PCT Pub. Date: Jan. 5, 2006

(65) Prior Publication Data

US 2008/0196282 A1 Aug. 21, 2008

(30) Foreign Application Priority Data

Jun. 23, 2004 (EP) ..... 04102895

(51) Int. Cl.
*D06F 75/26* (2006.01)
*D06F 75/24* (2006.01)

(52) U.S. Cl. ..... 38/77.7

(58) Field of Classification Search ..... 38/77.3–77.83, 38/93; 219/251, 252
See application file for complete search history.

(56) References Cited

U.S. PATENT DOCUMENTS

| | | | | |
|---|---|---|---|---|
| 2,387,757 | A | 10/1945 | Hoecker | |
| 2,499,835 | A | 3/1950 | Rakos | |
| 3,263,350 | A * | 8/1966 | Abraham | 38/77.7 |
| 4,939,342 | A | 7/1990 | Frens et al. | |
| 5,042,179 | A * | 8/1991 | van der Meer | 38/77.83 |
| 6,438,876 | B2 * | 8/2002 | Har et al. | 38/77.7 |
| 6,953,912 | B2 * | 10/2005 | Alday Lesaga | 219/251 |
| 6,992,267 | B2 * | 1/2006 | Wang | 219/251 |
| 2003/0094445 | A1 | 5/2003 | Lesaga | |
| 2004/0040185 | A1 * | 3/2004 | Morgandi et al. | 38/77.7 |

FOREIGN PATENT DOCUMENTS

| | | | |
|---|---|---|---|
| EP | 0232924 | B1 | 4/1990 |
| EP | 0390264 | A1 | 10/1990 |
| EP | 0543533 | A1 | 5/1993 |
| EP | 1 270 796 | | 1/2003 |
| WO | 199623099 | A | 8/1996 |

* cited by examiner

*Primary Examiner*—Ismael Izaguirre

(57) ABSTRACT

A steam iron assembly (1) comprises a steam iron (10), a steam generator (20) and a water reservoir (30). Furthermore, a pump (40) is provided for pumping water from the water reservoir (30) to the steam generator (20). Inside the steam generator (20), the water is heated to steam. The generated steam is conducted through the steam iron (10) to an item to be ironed. The steam iron (10) comprises a soleplate (11) having a contacting surface (12) for contacting items to be ironed. A temperature of the soleplate (11) is kept at a relatively low level of for example 110° C. throughout an entire steam ironing process, whereas variations of an ironing temperature are obtained on the basis of variations of a temperature of the supplied steam. As a result of these factors, the risk of scorching of the items to be ironed is reduced.

12 Claims, 1 Drawing Sheet

Figure 1:
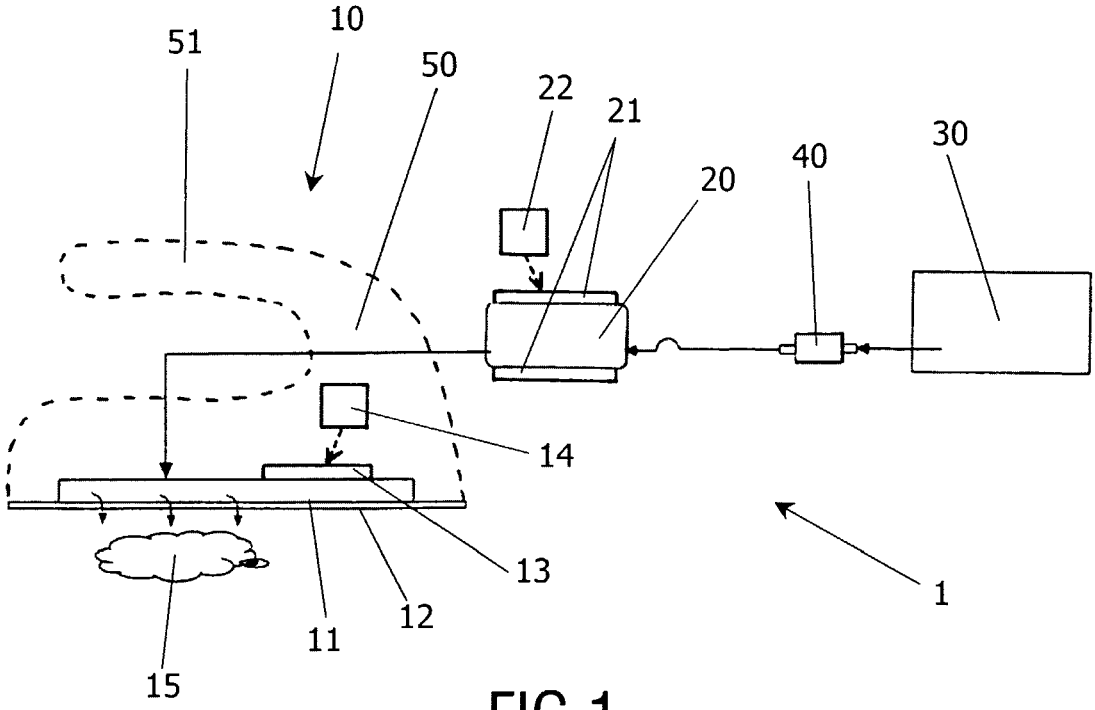

METHOD FOR CONTROLLING AN IRONING TEMPERATURE DURING A STEAM IRONING PROCESS AND A CORRESPONDING STEAM IRON

The present invention relates to a method for controlling an ironing temperature during a steam ironing process in which a steam iron having a soleplate for contacting items to be ironed and a steam generator for generating steam are applied.

Steam ironing processes are aimed at de-wrinkling fabric items such as garments or curtains. During a steam ironing process, the fabric item is flattened by means of a hot plate, while steam is supplied to the item to moisten the item, whereby the de-wrinkling effect of the ironing process is enhanced.

For the purpose of carrying out steam ironing processes, steam irons have been developed. A conventional steam iron comprises a soleplate having a contacting surface for contacting the items to be ironed, and a housing for accommodating various other components of the steam iron. The soleplate comprises a bottom portion of a steam chamber for generating steam during operation of the steam iron. A cover is provided for covering the soleplate and closing the steam chamber. The soleplate further includes a typically U-shaped tubular heating element, which serves for heating both the soleplate and the steam chamber during operation of the steam iron. When the steam chamber is heated, water that is inside the steam chamber is converted to steam. For the purpose of letting out steam, steam openings are arranged in the soleplate, which are in communication with the steam chamber.

During operation of the conventional steam iron as described in the preceding paragraph, the heating element is activated, and water is supplied to the steam chamber. Under the influence of the heat supplied by the heating element, the temperature of the contacting surface of the soleplate increases, while the temperature prevailing inside the steam chamber increases as well. As a result, water that is supplied to the steam chamber is converted into steam. During an ironing process in which the steam iron is applied, the items to be ironed are contacted by the hot contacting surface, while steam is supplied to these items through the steam openings.

It is a known fact that an ironing temperature, i.e. a temperature to which the item to be ironed is put during the ironing process, needs to be adjusted to the type of fabric of the item. For example, in case the item is made of cotton, the ironing temperature needs to be relatively high. Usually, in such case, the contacting surface of the soleplate of the steam iron is put to a temperature of about 200° C. However, for the purpose of ironing an item made of, for example, polyester, the ironing temperature should be much lower (about 150° C.) in order to avoid scorching of the item.

When the conventional steam iron, in which one heating element is used for heating both the contacting surface of the soleplate and the steam chamber, is applied for the purpose of items made of polyester or the like, there is a considerable chance that not all water is converted to steam in the steam chamber, due to the relatively low temperature. As a disadvantageous result, water droplets may be released by the steam iron, and it is even possible that scale particles are spit out by the steam iron along with the water droplets.

In US 2003/0094445, a solution to the problem mentioned in the above-mentioned paragraph is presented. According to this solution, a steam iron is provided, in which the temperatures of the steam generator and the contacting surface of the soleplate are controlled in an independent manner. Consequently, independently controllable heating elements are provided, wherein one of the elements serves for heating the steam chamber and wherein another of the elements serves for heating the soleplate. Moreover, both heating elements have their own thermostat.

During application of the steam iron as proposed in US 2003/0094445, it is possible to have a relatively low ironing temperature and still avoid the formation of water drops, due to the independence of the temperatures of the steam chamber and the contacting surface of the soleplate. During a steam ironing process in which delicate fabrics are ironed, the temperature of the contacting surface of the soleplate is set such as to be relatively low, so that the fabrics will not be scorched, while the temperature prevailing inside the steam generator is set to be so high that all water inside the steam generator is evaporated, whereby so-called dry steam is obtained.

Although the steam iron as proposed in US 2003/0094445 has important advantages, there are also some disadvantages associated with this steam iron. For example, when a user decides to iron a shirt made of polyester after having ironed a shirt made of cotton, the user needs to set the temperature of the contacting surface of the soleplate of the iron at a lower level, and then wait until the contacting surface has cooled down. In this situation, it is not inconceivable that the user does not have the patience to wait for the necessary temperature change. As soon as the user starts ironing the shirt made of polyester at a temperature, which is too high, scorching of the shirt may occur. This disadvantage is not only associated with the steam iron as proposed in US 2003/0094445, but also with other known steam irons.

It is an objective of the present invention to find a solution to the problem of the relatively long time involved in a change of the ironing temperature, while also avoiding the problem of the steam iron dripping water at low temperatures. According to the present invention, the objective is achieved by applying a method for controlling an ironing temperature during a steam ironing process in which a steam iron having a soleplate for contacting items to be ironed and a steam generator for generating steam are applied, wherein required changes of the ironing temperature are obtained on the basis of changes of a temperature of the generated steam, while a temperature of the soleplate is kept within a predetermined limited range of temperatures throughout the steam ironing process.

Contrary to conventional steam ironing processes, in which the temperature of the contacting surface of the soleplate of the applied steam iron is changed when the ironing temperature needs to be changed, the present invention proposes a steam ironing process in which a change of the ironing temperature is obtained by only varying the temperature of the steam that is supplied to the item to be ironed. According to the present invention, the temperature of the soleplate is kept at a substantially constant level throughout the entire ironing process, without regard to of the type of fabric that needs to be ironed.

In situations in which the steam ironing process according to the present invention is applied, a change of the ironing temperature is obtained on the basis of a change of the temperature of the steam that is supplied to the item to be ironed. The realization of a change of the temperature of the steam takes significantly less time than a change of the temperature of the soleplate. The difference is explained by taking into account the fact that the soleplate is a relatively bulky component of the steam iron, as the soleplate plays a role in flattening the items to be ironed.

As far as heat transfer to the items to be ironed is concerned, it is noted that studies which have been performed in the context of the present invention have shown that steam is more effective in heating up the items to be ironed than a hot contacting surface, due to an involvement of a mass transfer and latent heat. This is another reason why it is very advantageous to vary the temperature of the steam in order to obtain a variation of the ironing temperature, contrary to varying the temperature of the soleplate.

According to the present invention, the temperature of the soleplate of the steam iron is set such as to be within a predetermined limited range of temperatures. Preferably, the temperatures of this range are above the condensation temperature of steam, whereby it is ensured that the items to be ironed will not be stained by water droplets leaking from the steam openings of the steam iron.

In an embodiment of a steam iron suitable for carrying out the method according to the present invention, a thermostat for setting the temperature of the soleplate is adapted to keeping the temperature of the soleplate within a predetermined limited range. For example, this thermostat can be adapted such as to keep the temperature at a level of 110° C.

In case the soleplate is kept at a relatively low temperature, for example a temperature of 110° C., the chance of scorching fabrics is considerably reduced. Furthermore, at the start of the steam ironing process, it takes a relatively short time for the steam iron to heat up and get ready for use.

In the steam iron according to the present invention, the soleplate does not need to have a function in varying the ironing temperature. Two remaining functions of the soleplate are providing the contacting surface for flattening the items to be ironed, and serving as a conduit for the steam. For the purpose of carrying out these functions, it is not necessary that the soleplate comprises aluminium or another conventional material (metal). Instead, the soleplate may comprise a wide variety of materials, such as thermally conductive plastic and composite materials. According to an advantageous possibility, the soleplate comprises thermally conductive plastic which is not electrically conductive, wherein electrically conductive plastic is moulded in the thermally conductive plastic in order to create a resistive element for heating the soleplate.

It is noted that EP 1270796 discloses a so-called all steam iron with which ironing is conducted with supplied steam. The all steam iron does not comprise heating means for heating a contacting surface of the soleplate. During operation of the all steam iron, the soleplate is heated by the steam. The items to be ironed are flattened and stretched by the hot soleplate, moisturized by the steam and heated by the soleplate and the steam. The all steam iron is an industrial iron, the soleplate of which is heated under the influence of re-circulation of steam, in order to avoid condensation of steam to water droplets, causing spitting of water droplets during ironing. In the process, the temperature of the soleplate is kept above the condensation temperature of steam.

When the all steam iron is applied, the ironing temperature is determined by the temperature of the supplied steam. However, an important difference between the all steam iron and the steam iron according to the present invention is that in the all steam iron, the temperature of the soleplate varies along with the temperature of the supplied steam, whereas in the steam iron according to the present invention, the temperature of the soleplate is kept within a predetermined limited range.

Figure 2:
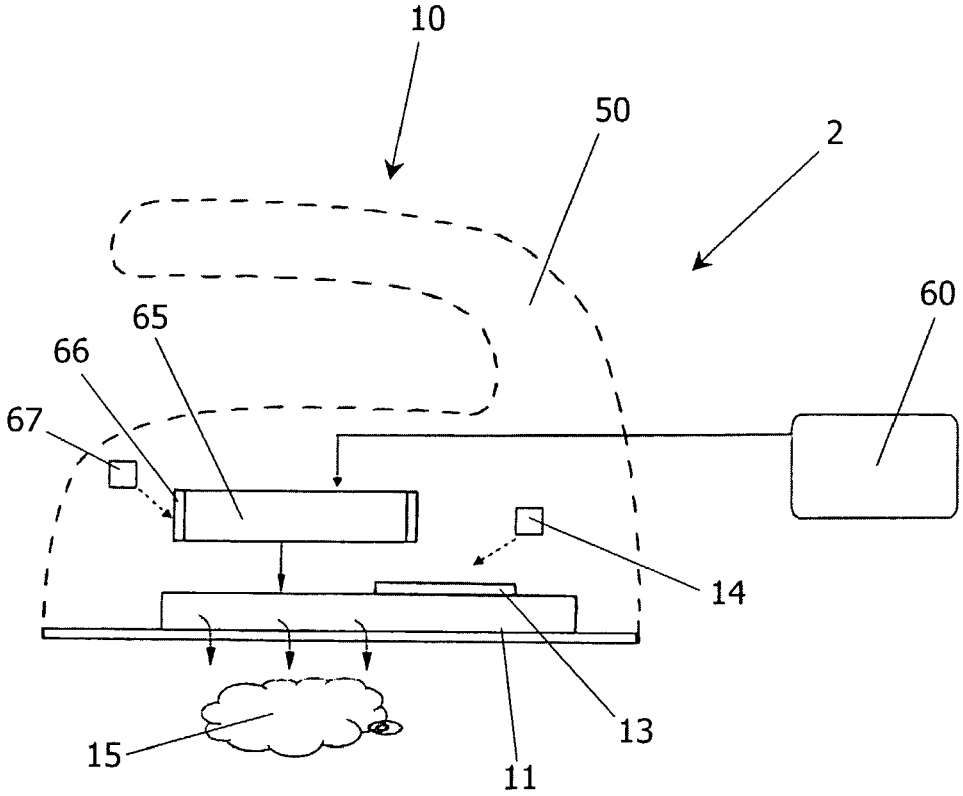

The present invention will now be explained in greater detail with reference to the figures, in which:

FIG. 1 diagrammatically shows components of a steam iron assembly according to a first preferred embodiment of the present invention and a course which is followed by water and steam through this steam iron assembly; and FIG. 2 diagrammatically shows components of a steam iron assembly according to a second preferred embodiment of the present invention and a course, which is followed by water and steam through this steam iron assembly.

FIG. 1 diagrammatically shows components of a steam iron assembly 1 according to a first preferred embodiment of the present invention. In the following, this steam iron assembly 1 will be referred to as first steam iron assembly 1. The first steam iron assembly 1 comprises a steam iron 10 having a soleplate 11. A planar contacting surface 12 of the soleplate 11 serves for contacting items to be ironed. In the soleplate 11, steam openings (not shown) for letting through steam are arranged. Furthermore, the first steam iron assembly 1 comprises a steam generator 20 for generating and supplying steam, a water reservoir 30 for containing water and a pump 40 for forcing water to flow from the water reservoir 30 to the steam generator 20.

Besides the soleplate 11, the steam iron 10 comprises a housing 50, which is positioned on top of the soleplate 11, and which has a handle 51 to enable a user to pick up the steam iron 10 and move the contacting surface 12 over an item to be ironed. In FIG. 1, the housing 50 is diagrammatically depicted by means of dashed lines. In the shown example, the steam generator 20, the water reservoir 30 and the pump 40 are arranged outside of the housing 50. That does not alter the fact that alternative embodiments in which these components are accommodated by the housing 50 are also possible within the scope of the present invention. In such embodiments, the pump 40 may be omitted or relocated.

For the purpose of heating the soleplate 11, first heating means 13 are provided. Preferably, these heating means 13 comprise at least one flat resistive heating element arranged on a surface of the soleplate 11, but another embodiment of the heating means 13 is also possible.

For completeness' sake, it is noted that flat resistive heating elements are heating elements, which are deposited as a thin layer on a surface by means of printing or other suitable techniques. Under the influence of an electric current, the flat resistive heating elements are capable of generating heat. For example, the flat resistive heating elements are formed by a layer of synthetic resin in which electrically conducting particles are embedded. When the flat resistive heating elements are arranged on a surface comprising an electrically conducting material such as metal, an electrically insulating layer needs to be arranged between the surface and the heating elements in order to avoid short-circuiting. Flat resistive heating elements can be arranged on planar surfaces, but it is also possible to arrange this type of heating elements on curved surfaces.

For the purpose of heating the content of the steam generator 20, second heating means 21 are provided. Like the first heating means 13, the second heating means 21 preferably comprise at least one flat resistive heating element, but it is also possible that the second heating means 21 are designed in another way.

During a steam ironing process in which the first steam iron assembly 1 is applied, an ironing temperature, i.e. a temperature at which the item to be ironed is actually ironed, is mainly determined by the temperature of the supplied steam. According to the present invention, both temperatures are controlled by means of thermostats or other suitable temperature controlling means. In FIG. 1, a first thermostat associated with the first heating means 13 for heating the soleplate 11 is indicated by reference numeral 14, and a second thermostat associated with the second heating means 21 for heating the content of the steam generator 20 is indicated by reference numeral 22.

According to an important aspect of the present invention, the first thermostat 14 has a fixed setting, while a setting of the second thermostat 22 is adjustable. In other words, the first thermostat 14 is adapted to keeping the temperature of the soleplate 11 within a predetermined limited range, while the second thermostat 22 is adapted to putting the steam exiting the steam generator 20 to a temperature which is related to a required ironing temperature. For the purpose of receiving input from a user regarding the required ironing temperature, the first steam iron assembly 1 comprises input means (not shown) such as a rotatably arranged disc or the like.

Prior to the start of a steam ironing process, the user checks the setting of the input means of the first steam iron assembly 1. In case the setting reflects the desires of the user, which are related to the type of fabric that needs to be ironed, there is no need for an adjustment of the setting of the input means. In case the setting of the input means is not representative of the required ironing temperature, the user adjusts the setting of the input means.

At the start of the steam ironing process, the soleplate 11 of the steam iron 10 is heated to a predetermined temperature, wherein the heating process is controlled by means of the first thermostat 14. The predetermined temperature may for example be 110° C. The first thermostat 14 is adapted to keeping the temperature of the soleplate 11 around this predetermined temperature throughout the steam ironing process.

Furthermore, the pump 40 is activated to pump water from the water reservoir 30 to the steam generator 20. In FIG. 1, a path, which is followed by the water, is indicated by means of arrows. Inside the steam generator 20, the water is evaporated to steam under the influence of heat supplied by the second heating means 21. The setting of the second thermostat 22 is determined by the setting of the input means, wherein a relation between these two settings is determined by the requirement that the second thermostat 22 has to control the second heating means 21 in such a way that the set ironing temperature is reached on the basis of the temperature of steam exiting the steam generator 20.

The generated steam is supplied to the steam iron 10, and is supplied to the item to be ironed through the steam openings in the soleplate 11 of the steam iron 10. In FIG. 1, a path which is followed by the steam from the steam generator 20 to the soleplate 11 of the steam iron 10 is indicated by means of an arrow, and a path which is followed by the steam through the soleplate 11 and the steam openings is indicated by three relatively small arrows. A cloud of steam, which is released by the steam iron 10 through the steam openings, is diagrammatically depicted in FIG. 1 and indicated by reference numeral 15.

As soon as the user changes the setting of the input means during the steam ironing process, the setting of the second thermostat 22 and the operation of the second heating means 21 are changed as well, while the setting of the first thermostat 14 remains the same. In case the input means indicate that a higher ironing temperature is required, the second thermostat 22 is set at a higher temperature and the second heating means 21 are controlled such as to supply more heat to the content of the steam generator 20, so that the temperature of the steam exiting the steam generator 20 is increased. In case the input means indicate that a lower ironing temperature is required, the second thermostat 22 is set at a lower temperature and the second heating means 21 are controlled such as to supply less heat to the content of the steam generator 20, so that the temperature of the steam exiting the steam generator 20 is decreased. According to this procedure, a variation of the requested ironing temperature is obtained on the basis of a variation of the temperature of the steam only.

Contrary to the conventional situation in which the ironing temperature is mainly determined by the temperature of the soleplate, in this case, the ironing temperature is mainly determined by the temperature of the supplied steam when the first steam iron assembly 1 is applied. For example, for the purpose of ironing polyester, the steam temperature is set around 150° C., and for the purpose of ironing cotton, the temperature is set at a higher level, approximately 180-200° C. The temperature of the steam can easily be varied by adjusting the setting of the second thermostat 22 and/or varying a power supply to the steam generator 20.

Throughout the steam ironing process, the temperature of the soleplate 11 of the steam iron 10 is kept around a constant level under the influence of the first thermostat 14. The temperature of the soleplate 11 is kept at a relatively low level. Preferably, the temperature of the soleplate 11 is just high enough to ensure that the formation of water droplets in the supplied steam does not occur. A suitable value of the temperature of the soleplate 11 is 110° C., which is a temperature just above the condensation temperature of steam.

An important advantage of the first steam iron assembly 1 is that required changes of the ironing temperature are very quickly realized, as such changes only require a change of the temperature of the supplied steam. Therefore, a situation in which a temperature of the soleplate is too high and the item to be ironed gets scorched is virtually excluded.

Another important advantage of the first steam iron assembly 1 is that the temperature of the soleplate 11 of the steam iron 10 may be at a relatively low level of for example 110° C., whatever the circumstances. Measures may be taken to stop the production of steam as soon as the hand of the user is off the steam iron 10. In this way, it is assured that the temperature of the item to be ironed is only influenced by the temperature of the contacting surface 12 of the soleplate 11 when the steam iron 10 is left unattended. As the temperature of the contacting surface 12 is relatively low, there is little risk of the item to be ironed getting scorched. The application of the first steam iron assembly 1 is safe with respect to the application of a conventional steam iron or a conventional steam iron assembly. In the latter case, the temperature of the contacting surface of the soleplate of the steam iron may be much higher than 110° C., for example 150° C. or even 230° C.

As a result of the relatively low temperature of the soleplate 11, a heat up time of the steam iron 10 is relatively short, especially in case the soleplate 11 is chosen such as to be a low mass type soleplate. For example, the time it takes to heat up to a temperature of 110° C. is only 18 seconds for a soleplate 11 of 200 grams, starting from an initial temperature of 25° C.

As the temperature of the soleplate 11 of the steam iron 10 is kept at a more or less constant level, which is relatively low, many materials are suitable to be incorporated in the soleplate 11. For example, thermally conductive plastics or composite materials may be applied. It is also possible that the soleplate 11 comprises a conventional material such as aluminium.

In case the soleplate 11 comprises a thermally conductive plastic, the first heating means 13 may comprise at least one portion of electrically conductive plastic that is moulded in the thermally conductive plastic such as to create a flat resistive heating element.

It will be clear to a person skilled in the art that the scope of the present invention is not limited to the examples discussed in the foregoing, but that several amendments and modifications thereof are possible without deviating from the scope of the present invention as defined in the attached claims.

With respect to the first heating means 13 for heating the soleplate 11, it is noted in the foregoing that these means 11 preferably comprise at least one flat resistive heating element. It is also very well possible that the first heating means 13 comprise at least one PTC heating element (PTC stands for Positive Temperature Coefficient). An important feature of such a heating element is that its electrical resistance rises as the temperature rises. As a consequence, a PTC heating element is very well applicable for the purpose of keeping a temperature within a predetermined range. In case the first heating means 13 comprise a PTC heating element, there is no need for a thermostat for controlling the operation of these heating means 13, and the first thermostat 14 can be omitted.

In the foregoing, a steam iron assembly 1 is disclosed, which comprises a steam iron 10, a steam generator 20 and a water reservoir 30. Furthermore, a pump 40 is provided for pumping water from the water reservoir 30 to the steam generator 20. Inside the steam generator 20, the water is heated to steam. The generated steam is conducted through the steam iron 10 to an item to be ironed.

The steam iron 10 comprises a soleplate 11 having a contacting surface 12 for contacting items to be ironed. A temperature of the soleplate 11 is kept at a relatively low level of for example 110° C. throughout an entire steam ironing process, whereas variations of an ironing temperature are obtained on the basis of variations of a temperature of the supplied steam.

Due to the relatively low and constant level of the temperature of the soleplate 11, and the fact that variations of the ironing temperature can be realized very quickly, the risk of scorching of the items to be ironed is reduced.

FIG. 2 diagrammatically shows components of a steam iron assembly 2 according to a second preferred embodiment of the present invention. In the following, this steam iron assembly 2 will be referred to as second steam iron assembly 2. Like the first steam iron assembly 1, the second steam iron assembly 2 comprises a steam iron 10 having a soleplate 11 and a housing 50, and first heating means 13 for heating the soleplate 11. Furthermore, the second steam iron assembly 2 comprises a boiler 60 for converting water to steam, which is located outside of the steam iron 10.

During operation of the second steam iron assembly 2, steam exits the boiler 60 and is transported to the steam iron 10. In many cases, the steam supplied by the boiler 60 is saturated, and steam condenses on the way to the steam iron 10. In order to convert the water that is obtained as a result of the condensing process to steam again, the steam and the water are re-heated in the steam iron 10. For this purpose, the steam iron 10 comprises a re-heating device 65. This re-heating device 65 comprises conducting means for conducting the water and the steam, for example multi-steam channels or chambers, and second heating means 66 for heating the water and the steam.

Like the first steam iron assembly 1, the second iron assembly 2 comprises input means (not shown), by means of which a user is capable of setting a required ironing temperature. According to an important aspect of the present invention, the temperature of the soleplate 11 is maintained within a predetermined limited range of temperatures, without regard to the setting of the input means, while the temperature of the steam exiting the re-heating device 65 is accurately controlled in order to realize the required ironing temperature.

The temperature of the soleplate 11 is controlled by means of a first thermostat 14, which is associated with the first heating means 13. In a suitable embodiment, this thermostat 14 has a fixed setting. For example, the first thermostat 14 is set to keep the temperature of the soleplate 11 at 110° C.

The operation of the second heating means 66 is controlled by a second thermostat 67. The setting of the second thermostat 67 is related to the setting of the input means, which is representative of the required ironing temperature. The second thermostat 67 may for example be coupled to power control means (not shown), by means of which the operating power that is supplied to the second heating means 66 is controlled.

During operation of the second steam iron assembly 2, the following steps take place:

Step 1: Water is converted to steam in the boiler 60.

Step 2: The steam is transported to the steam iron 10. This is diagrammatically depicted in FIG. 2 by means of an arrow starting from the boiler 60.

Step 3: The steam, which is partly condensed, is heated in the re-heating device 65.

Step 4: The steam is transported from the re-heating device 65 to the soleplate 11. This is diagrammatically depicted in FIG. 2 by means of an arrow starting from the re-heating device 65.

Step 5: The steam exits the soleplate 11 through steam openings. These steam openings are not shown in FIG. 2, but a path which is followed by the steam through the soleplate 11 and the steam openings is indicated by three curved arrows. Furthermore, a cloud of steam, which is released by the steam iron 10 through the steam openings, is diagrammatically depicted in FIG. 2 and indicated by reference numeral 15.

During the above-sketched process, the temperature of the soleplate 11 is kept around a fixed temperature, whereas the temperature of the steam supplied by the re-heating device 65 is accurately controlled such as to realize the required ironing temperature. In the re-heating device 65, the steam is heated under the influence of the second heating means 66. Important factors which play a role in determining the temperature of the steam are the heating power supplied by the second heating means 66 and the flow of the steam through the re-heating device 65. Preferably, it is not only possible to vary the supplied heating power, but also the flow. For the purpose of controlling the flow, flow control means of any suitable type may be arranged.

On the basis of the foregoing, it will be clear that there are many similarities between the second steam iron assembly 2 and the first steam iron assembly 1. In fact, the only significant difference is that the second steam iron assembly 2 comprises a combination of a boiler 60 and a re-heating device 65 for supplying the steam, whereas the first steam iron assembly 1 comprises a single steam generator 20 for the same purpose. Therefore, it will be clear that both steam iron assemblies 1, 2 function according to the same principles, and offer the same advantages. Consequently, many remarks which are made in respect of the first steam iron assembly 1 are also applicable to the second iron assembly 2. For example, it is also true for the second steam iron assembly 2 that the soleplate 11 may comprise a thermally conductive plastic or a composite material, and that the heating means 13, 66 preferably comprise at least one flat resistive heating element. Also, in the second steam iron assembly 2, the first heating means 13 may comprise at least one PTC heating element in stead of at least one flat resistive heating element, wherein the first thermostat 14 may be omitted.

The invention claimed is:

1. Method for controlling an ironing temperature during a steam ironing process, the method comprising:

generating steam by means of a steam generator of a steam iron; and changing the ironing temperature on the basis of changes of a temperature of the generated steam; and maintaining a temperature of a soleplate of the steam iron within a predetermined limited range of temperatures throughout the steam ironing process, wherein the predetermined limited range of temperatures is fixed and unchangeable.

2. Method according to claim 1, wherein the temperature of the soleplate is maintained at a level just above the condensation temperature of steam.

3. Method according to claim 1, wherein the temperature of the soleplate is maintained within a limited range of temperatures around a temperature of 110° C.

4. Method according to claim 1, wherein the temperature of the steam is varied on the basis of a variation of a power supply to the steam generator.

5. Steam iron assembly, comprising:

a steam iron having a soleplate for contacting items to be ironed;

steam generating means for generating and supplying steam;

first heating means associated with the soleplate of the steam iron;

second heating means associated with the steam generating means;

a first thermostat, which is adapted to keeping the temperature of the soleplate within a predetermined limited range; and a second thermostat, which is adapted to setting the temperature of the steam supplied by the steam generating means to a temperature that corresponds to an ironing temperature;

wherein required changes of the ironing temperature are made on the basis of changes of the temperature of the generated steam, while the temperature of the soleplate is maintained within the predetermined limited range of temperatures throughout the steam ironing process, and wherein the predetermined limited range of temperatures is fixed and unchangeable.

6. Steam iron assembly according to claim 5, wherein the first thermostat is adapted to maintaining the temperature of the soleplate of the steam iron at a level just above the condensation temperature of steam.

7. Steam iron assembly according to claim 5 or 6, wherein the first thermostat is adapted to maintaining the temperature of the soleplate of the steam iron within a limited range of temperatures around a temperature of 110° C.

8. Steam iron assembly according to claim 5, comprising at least one flat resistive heating element.

9. Steam iron assembly according to claim 5, wherein the soleplate of the steam iron comprises a thermally conductive plastic.

10. Steam iron assembly according to claim 9, wherein the first heating means comprise at least one flat resistive heating element, which is shaped as an element comprising electrically conductive plastic that is moulded in the thermally conductive plastic of the soleplate of the steam iron.

11. Steam iron assembly according to claim 5, wherein the soleplate of the steam iron comprises a composite material.

12. Steam iron assembly, comprising:

a steam iron having a soleplate for contacting items to be ironed;

steam generating means for generating and supplying steam;

first heating means comprising at least one PTC heating element associated with the soleplate of the steam iron, which is capable of keeping the temperature of the soleplate within a predetermined limited range;

second heating means associated with the steam generating means; and a thermostat, which is adapted to setting the temperature of the steam supplied by the steam generating means to a temperature that corresponds to an ironing temperature;

wherein required changes of the ironing temperature are made on the basis of changes of the temperature of the generated steam, while the temperature of the soleplate is maintained within the predetermined limited range of temperatures throughout the steam ironing process, and wherein the predetermined limited range of temperatures is fixed and unchangeable.

* * * * *